US005979279A

United States Patent [19]

Matsumoto et al.

[11] Patent Number: 5,979,279

[45] **Date of Patent: *Nov. 9, 1999**

[54] RAPPING DEVICE AND RAPPING METHOD

[75] Inventors: Yoshichika Matsumoto; Kazuyuki Hironaga, both of Hirakata; Tadahiro Sawada, Neyagawa, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/770,736

[22] Filed: Dec. 18, 1996

[30] Foreign Application Priority Data

Dec. 22, 1995 [JP] Japan ..... 7-334417

[51] Int. Cl.[6] ..... B26D 1/62; B26D 7/06; B26D 7/18; B26F 1/08

[52] U.S. Cl. ..... 83/24; 83/37; 83/99; 83/100; 83/152; 83/339; 83/346; 264/153

[58] Field of Search ..... 83/24, 27, 98, 83/99, 100, 102, 152, 343, 346, 37, 112, 53, 177, 323, 339, 402, 425.1; 264/138, 153

[56] References Cited

U.S. PATENT DOCUMENTS

| | | | |
|---|---|---|---|
| Re. 16,429 | 9/1926 | Speer | 83/37 |
| 420,524 | 2/1890 | Wheeler | 83/343 X |
| 1,482,776 | 2/1924 | Abraham | 83/343 X |
| 1,635,166 | 7/1927 | Albee | 83/346 X |
| 3,172,321 | 3/1965 | Schrader | 83/346 X |
| 3,431,830 | 3/1969 | Stovall | 83/343 X |
| 3,611,855 | 10/1971 | Thousand, Jr. | 83/100 |
| 3,872,752 | 3/1975 | Remde et al. | 83/152 X |
| 4,276,800 | 7/1981 | Koppa et al. | 83/100 X |
| 4,549,454 | 10/1985 | Yamashita | 83/27 |
| 4,641,558 | 2/1987 | Hoffmann | 83/152 |
| 4,943,341 | 7/1990 | Mattei | 83/323 X |
| 5,083,487 | 1/1992 | Croteau | 83/177 X |
| 5,109,741 | 5/1992 | Fuchs | 83/152 X |
| 5,540,127 | 7/1996 | Binder et al. | 83/343 X |
| 5,609,084 | 3/1997 | Gronbjerg | 83/98 X |

FOREIGN PATENT DOCUMENTS

| | | | |
|---|---|---|---|
| 1351105 | 3/1963 | France | 83/343 |

*Primary Examiner*—Rinaldi I. Rada
*Assistant Examiner*—Boyer Ashley
*Attorney, Agent, or Firm*—Ratner & Prestia

[57] ABSTRACT

A rapping device is provided for forming a battery separator or the like by rapping from a flexible elastic band material. A rapping device for manufacturing works in a specified shape by rapping from an elastic band material comprises a conveying drum having a first suction unit and a second suction unit for conveying the band material while suction is applied, a die drum having a blade possessing a forming position for rapping and forming the works with a width coinciding with the width of the band material, and a cutting position for cutting between the adjacent works, disposed continuously on the outer circumference at every pitch equal to the length of each work, and a die drum driving device for rotating and driving the die drum in synchronization with the conveying speed of the band material.

14 Claims, 3 Drawing Sheets

RAPPING DEVICE AND RAPPING METHOD

BACKGROUND OF THE INVENTION

1.Technical Field of the Invention

The present invention relates to a rapping device and rapping method for forming a work such as a battery separator by rapping using a flexible elastic band material.

2. Prior Art

A 9 V square battery laminating six 1.5 V unit cells in the vertical direction usually has an insulating separator provided in the laminates in order to insulate the laminated unit cells. This separator comprises a work 1 as shown in FIG. 4, and this work 1 is manufactured by rapping using a soft band material 103 such as kraft paper of about 0.15 mm in thickness.

In a conventional rapping device, to convey the band material 103 to the rapping position, a feed beam of about several millimeters is provided in the band material 103, and this feed beam 25 is pulled and manipulated by a roller or the like. The band material 103 is flexible and cannot be fed by pushing.

In this type of conveying means, due to expansion or slip of the material, it is hard to control the feed rate accurately, and processing precision of the work 1 itself cannot be assured. Accordingly, positioning means such as a pilot hole is provided in the feed beam 25 of the band material 103, or an allowance 26 of about several millimeters is provided between adjacent works 1 as shown in FIG. 4.

However, as in the prior art, a feed beam 25 or an allowance 26 in the band material 103 is ultimately discarded, thereby causing the material yield to decrease and the cost to increase.

SUMMARY OF THE INVENTION

The rapping device of the invention is for manufacturing a plurality of works in a specified shape from an elastic band material by rapping. The rapping device is comprised of conveying means having a suction unit for sucking and conveying the band material, a rapping die provided with a blade having (1) a forming position for rapping and forming works having a width matching the width of the band materials and (2) a cutting position for cutting between mutually adjacent works, and rapping die driving means for driving the rapping die to form the works continuously in synchronism with the conveying speed of the band material.

Another rapping device of the invention is for manufacturing a plurality of works in a specified shape from an elastic band material by rapping. The rapping device is comprised of a conveying drum having (1) a suction unit for sucking and conveying the band material, a die drum provided with blades having a forming position for rapping and forming works having a width matching the width of the band materials and (2) a cutting position for cutting between mutually adjacent works disposed continuously on the outer circumference, at every pitch equal to the length of each work, and die drum driving means for rotating and driving the die drum in synchronism with the conveying speed of the band material.

Preferably, the suction unit of the conveying drum has a first suction unit for sucking the middle of the band material and a second suction unit for sucking both sides of the band material. Preferably, the first suction unit and second suction unit are provided in every pitch equal to the length of each work, and the first suction unit and second suction unit both suck the band material up to the rapping position, and after the rapping position, consequently, the first suction unit sucks the work and the second suction unit sucks the remaining part (the remainder) other than the work, thereby conveying each to a take-out, removal or discharge position.

More preferably, the suction unit of the conveying drum operates in a vacuum.

Further preferably, means for feeding compressed air is provided at the take-out position of the work or remainder. Using the compressed air feeding means, the work or remainder after rapping is separated from the suction unit by force.

In particular, preferably, the work is a separator for battery. The rapping method of the invention is for manufacturing a plurality of works having a specified shape from an elastic band material, comprising (1) a step of conveying the band material to the rapping position while operating in a vacuum and holding the band material by conveying means, and (2) a step of rapping and forming by separating the works having a specified shape and the remainder mutually from the band material by rapping means, while being held by the conveying means at the rapping position.

Preferably, the rapping method of the present invention further comprises (3) a step of conveying the rapped and formed works to a first take-out position while being held by suction by the conveying means.

Preferably, the rapping method further comprises (4) a step of separating the works from the conveying means by blowing air having a positive air pressure to the works at the first take-out position.

Preferably, the rapping method further comprises (5) a step of conveying the remainder to a second take-out position while being held by suction by the conveying means.

Preferably, the rapping method further comprises (6) a step of separating the remainder from the conveying means by blowing air having a positive air pressure to the remainder at the second take-out position.

In this manner, since the conveying means possesses the suction unit, the band material can be conveyed while being held by suction, so that the band material can be conveyed securely without the necessity of means such as a feed beam in the band material. The blade of the rapping die has the forming position for rapping and forming the works having a width matching with the width of the band material, and when rapped and formed by this blade, the feed beam or other portions of the band material that are conventionally wasted are not wasted, and the material yield is improved and the cost is reduced.

Due to the suction unit, the band material can be conveyed without slippage or the like, the rapping device does not require particular positioning means such as a pilot hole, and the conveying distance can be controlled. At the same time, depending on the conveying distance of the band material, the rapping die driving means drives the rapping die to cut continuously the boundary of adjacent works at the cutting position of the blade, and the conventionally wasted material between works is eliminated, so that the material yield may be further enhanced.

The conveying means is, in one embodiment, a conveying drum, and the blade is provided continuously on the outer circumference of the rapping die drum at every pitch equal to the length of the work. The die drum is rotated in synchronism with the conveying distance of the band material by the die drum driving means, so that high speed and continuous rapping is realized, thereby greatly enhancing the productivity.

Moreover, the suction unit is composed of a first suction unit and a second suction unit. The band material is conveyed to the rapping position by the suction units, and after rapping, the work is conveyed to the take-out position by the first suction means, and the remainder is separately conveyed to the take-out position by the second suction unit. Accordingly, only the works are continuously sent into next process, while the remainder is discharged easily, so that the productivity is enhanced.

At the take-out position of the works and/or remainder, by sending compressed air to the suction unit, the works and/or remainder are separated from the suction unit by force, so that sending the works to next process and discharging the remainder is securely performed.

The word "rapping" means die cutting or dieing.

REFERENCE NUMERALS

1 Work

2 Remainder

3 Band material

4 Blade

4*a* Forming position

4*b* Cutting position

5 Die drum

6 Conveying drum

51 Die drum driving means

A Rapping position

S First suction unit

T Second suction unit

DESCRIPTION OF THE PREFERRED EMBODIMENT

Figure 1:
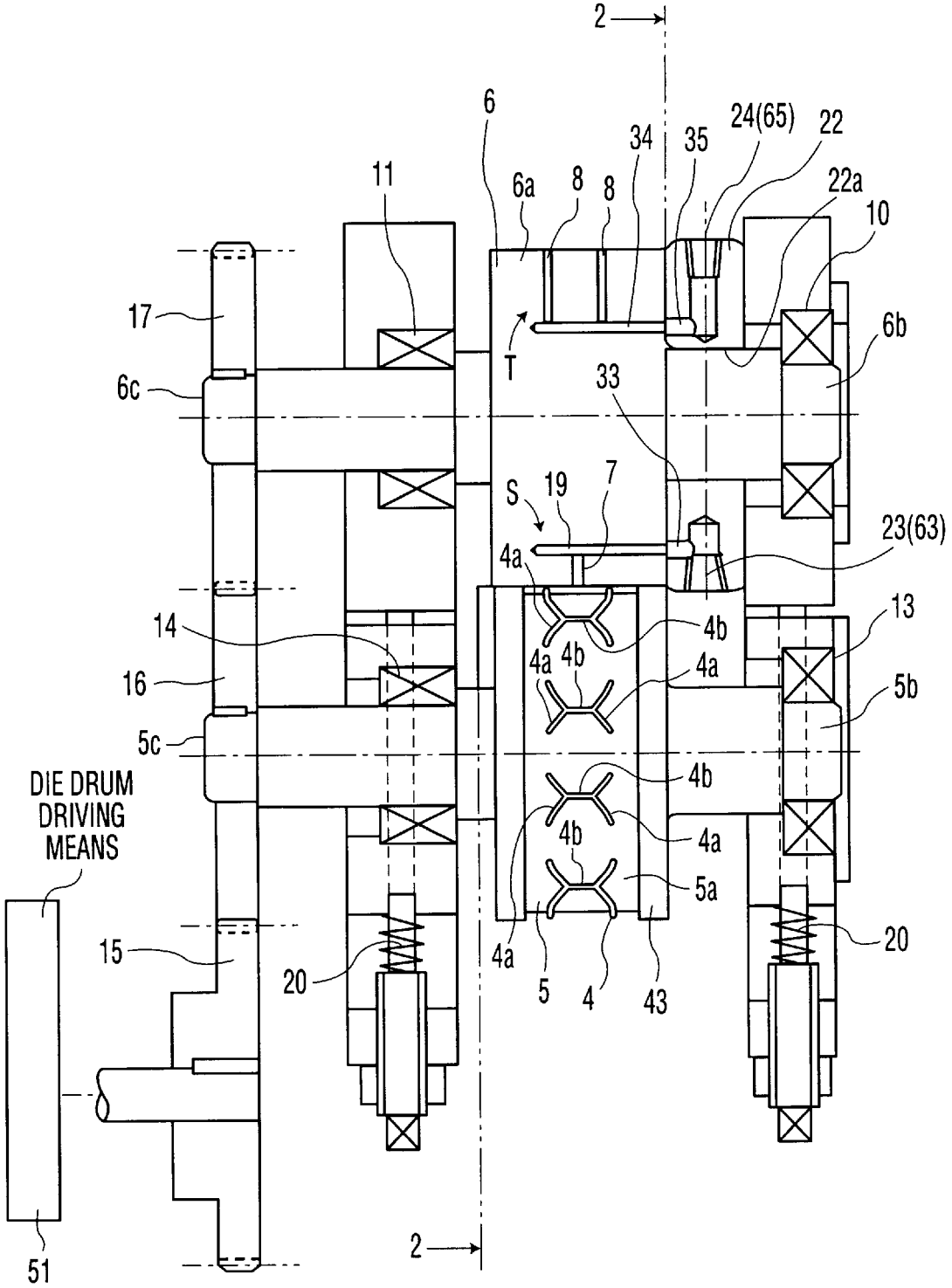
FIG. 1 is a side view showing an exemplary embodiment of a rapping device in accordance with the present invention.

An exemplary embodiment of the invention is described below while referring to the drawings.

Figure 2:
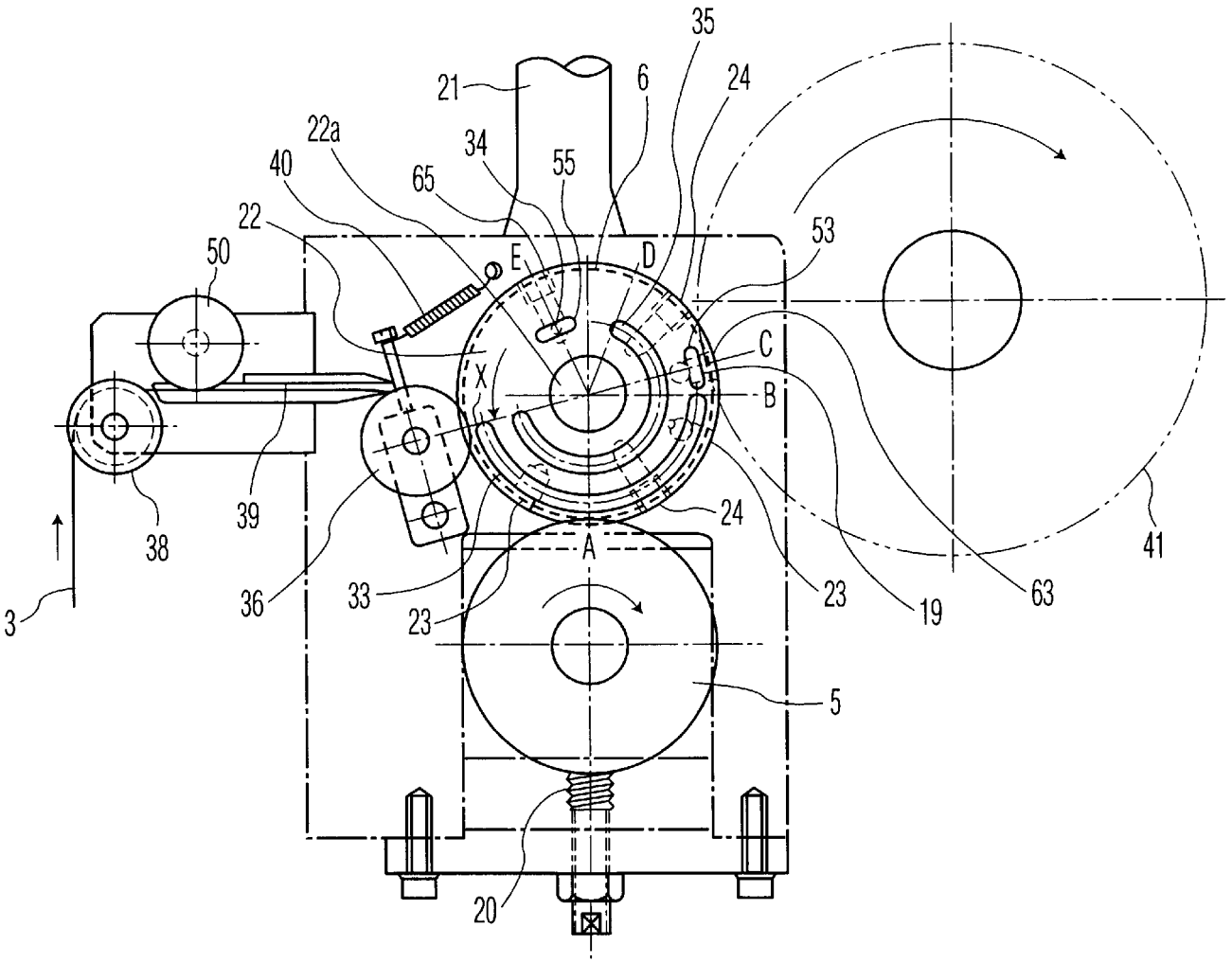
FIG. 2 is a sectional view cut along 2—2 in FIG. 1.
Figure 3:
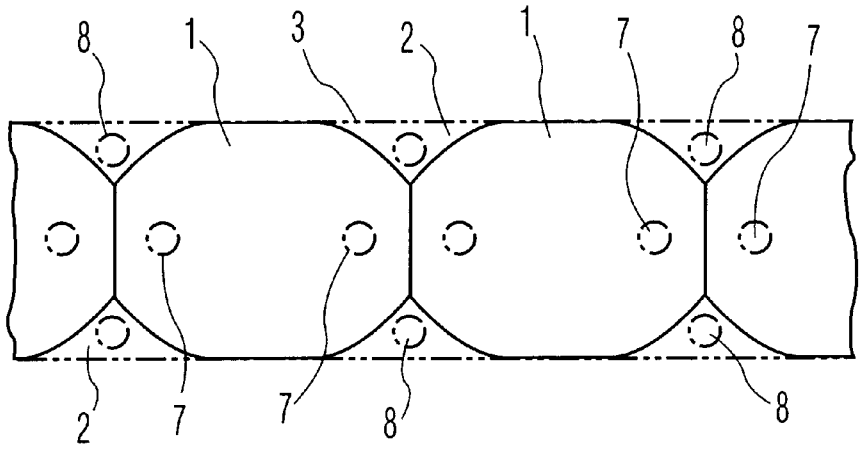
FIG. 3 is a plan view showing a configuration of band material, works, remainder, first intake hole and second intake hole used in an exemplary embodiment of the present invention.
Figure 4:
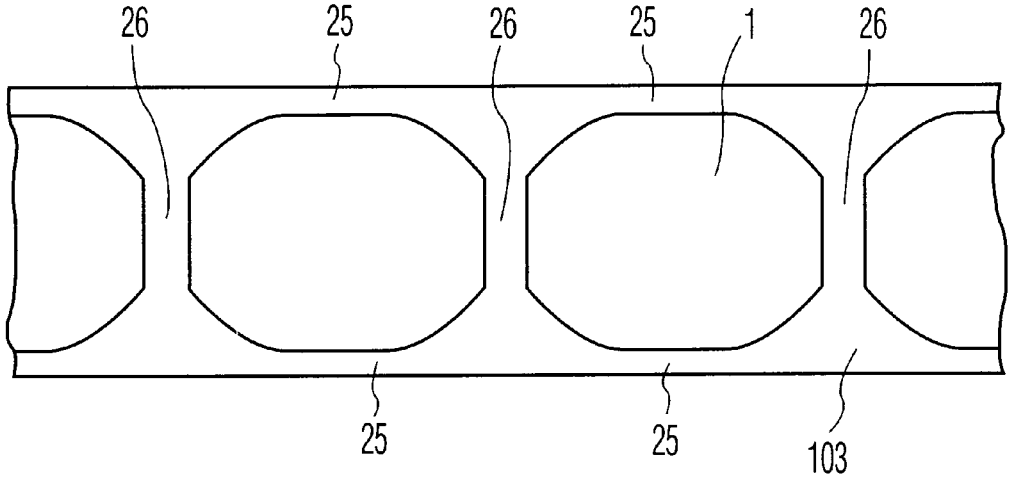
FIG. 4 PRIOR ART
FIG. 4 is a plan view showing a conventional configuration of works and remainder in the prior art.

A side view of an embodiment of a rapping device of one embodiment of the invention is shown in FIG. 1. A sectional view along 2—2 in FIG. 1 is shown in FIG. 2. An exemplary configuration of the band material, works and others used in the embodiment is shown in FIG. 3.

This exemplary embodiment relates to a rapping device for forming a work 1 which is an insulating separator used in a 9 V square battery. The band material 3 is preferably kraft paper of about 0.15 mm in thickness.

The rapping device of the embodiment comprises a feed unit of the band material 3, a conveying drum 6 for sucking and conveying the band material 3, a slip disk 22, a die drum 5 contacting the conveying drum 6 at rapping position A, and die drum driving means 51.

The feed unit is composed of, as shown in FIG. 2, a rotor 38, a holding roller 50, a side defining plate 39, and a pressing roller 36. The band material 3 is supplied into the conveying drum 6 at position X through the rotor 38, holding roller 50 and pressing roller 36. By installing the holding roller 50 and side defining plate 39 between the rotor 38 and conveying drum 6, oscillations of the band material 3 in the vertical and lateral direction are prevented. By the thrusting force of a tension spring 40, the pressing roller 36 is in contact with the conveying drum 6 having the band material 3 between them, so that the band material 3 is supplied into the conveying drum 6 at position X stably without being loosened.

The conveying drum 6 has shafts 6*b*, 6*c* provided at both ends as shown in FIG. 1, and a drum 6*a* is provided in the middle. The shafts 6*b*, 6*c* are respectively supported by bearings 10, 11. At the outer circumference of the drum 6*a*, a first intake hole 7 -comprising first suction unit S is provided in the middle, and communicates with a first intake route 19 inside. The first intake hole 7 is provided in multiple positions on the entire outer circumference of the drum 6*a* at every pitch equal to the length of the work 1 to provide suction to the middle of the work 1 at two positions as shown in FIG. 3. The first intake route 19 is a hole provided to the inside from the concentric hole at the right side of the drum 6*a*, and is formed to a depth appropriate to communicate with each first intake hole 7.

Further at the outer circumference of the drum 6*a*, there is a second intake hole 8 for sucking the remaining band material (the remainder 2) other than the work 1 of the band material 3 comprising second suction unit T. The second intake hole 8 is provided in multiple positions at every pitch corresponding to each position of the remainder 2 formed at both sides of the band material 3, at a rate of one for every remainder 2 as shown in FIG. 3. As with the first intake route 19, a second intake route 34 is provided at the right side of the drum 6*a* to communicate with each second intake hole 8 and is positioned on the concentric circle at the inner side of the concentric circle of the first intake route 19.

The slip disk 22 is a disk having nearly the same diameter as the drum 6*a* of the conveying drum 6 as shown in FIGS. 1 and 2, and is inserted into the shaft 6*b* of the conveying drum 6 through a hole 22*a* provided in the center. However, the slip disk 22 is fixed, and the drum 6*a* rotates with its right side kept in contact with the left side of the slip disk 22.

In the middle of the outer circumference of the slip disk 22, two first vacuum holes 23 are provided at a proper interval between position X and position B in FIG. 2, a first feed hole 63 is provided at position C, two second vacuum holes 24 are provided at a proper interval between position X and position D, and a second feed hole 65 is provided at position E.

At the left side of the slip disk 22, a first vacuum groove 33, having an arc shape, is provided from position X to position B on the concentric circle with the first intake route 19 provided from the right side of the drum 6*a* of the conveying drum 6. The first vacuum groove 33 communicates with the first vacuum holes 23, and a first feed groove 53, having an arc shape, is provided near position C concentrically, and the first feed groove 53 communicates with the first feed hole 63. Similarly, a second vacuum groove 35, having an arc shape, is provided from position X to position D on the concentric circle with the second intake route 34, and the second vacuum groove 35 communicates with the second vacuum holes 24, and a second feed groove 55, having an arc shape, is provided near position E concentrically, and the second feed groove 55 communicates with the second feed hole 65.

The first vacuum holes 23 and the second vacuum holes 24 are connected to a vacuum device (not shown) to be evacuated, and the first vacuum groove 33 and second vacuum groove 35 communicating with them are held in a vacuum state between the right side of the drum 6*a* and the left side of the slip disk 22.

The first feed hole 63 and the second feed hole 65 are connected to a compressor (not shown), and compressed air is fed through them, and the first feed groove 53 and second feed groove 55 communicating with them are held in a positive pressure state between the right side of the drum 6*a* and the left side of the slip disk 22.

The die drum 5 has shafts 5*b,* 5*c* provided at both sides as shown in FIG. 1, and a drum 5*a* is provided in the middle. The shafts 5*b,* 5*c* are supported respectively by bearings 13, 14. The drum 5*a* has flanges 43 provided at both sides on the outer circumference, and plural blades 4 described below are provided continuously at every pitch on the whole outer circumference in the middle. The outer diameter of the drum 5*a* is equal to the outer diameter of the drum 6*a* of the conveying drum 6.

Each blade 4 has a shape corresponding to the work 1 in FIG. 3, and comprises a forming position 4*a* for rapping and forming the work 1 having a width coinciding with the width of the band material 3, and a cutting position 4*b* for cutting between mutually adjacent works 1. Thus, since the band material 3 and the work 1 have the same width, it is not necessary to position the blades 4 at positions corresponding to the center and both sides of the works 1, and it is sufficient to provide them intermittently as shown in FIG. 1.

The flange 43 contacts the outer circumference of the drum 6*a* of the conveying drum 6. The height of the flange 43 is nearly equal to the height of the blade 4. When the blade 4 is slightly lower than the flange 43, the blade 4 is protected during rapping.

The conveying drum 6 and die drum 5 are restrained from moving in the thrust direction by the bearings 10, 11 and bearings 13, 14 through the shafts 6*b,* 6*c* and shafts 5*b,* 5*c,* so that the drum 6*a* and drum 5*a* always contact at a fixed position. Accordingly, the shape of the works 1 rapped from the band material 3 is not changed, and rapping with stable dimensional precision is realized.

The die drum driving means 51 comprises a motor, and a gear 15 is provided at the leading end of its drive shaft. The gear 15 is engaged with a gear 16 provided on the shaft 5*c* of the die drum 5, thereby driving the die drum 5.

The gear 16 is also engaged with a gear 17 provided on the shaft 6*c* of the conveying drum 6, and thus the die drum driving means 51 also drives the conveying drum 6. The gears 16, 17 have an equal number of teeth, so that the conveying drum 6 and die drum 5 rotate in reverse synchronism. The engagement of the gears 16, 17 is determined so that the first intake holes 7 and the second intake holes 8 of the conveying drum 6 are located at the position as shown in FIG. 3 with respect to the blades 4 of the die drum 5.

The process and operation of this rapping device are described below. The band material 3 is supplied from the feed unit into the conveying drum 6 at position X. Between position X to the first vacuum groove 33 and second vacuum groove 35 in vacuum state, the first intake route 19 and second intake route 34 communicate respectively. Vacuum is applied to the band material 3 from the first intake holes 7 and second intake holes 8 through the first intake route 19 and second intake route 34, and the band material 3 is sucked onto the outer circumference of the drum 6*a*.

At this time, the band material 3 is accurately defined in the middle of the drum 6*a* by the side defining plate 39, and the conveying drum 6 sucks the middle of the band material 3 from the first intake holes 7, and both sides of the band material from the second intake holes 8. Since the conveying drum 6 is rotating continuously, and simultaneously with suction, the band material 3 is conveyed to the rapping position A.

At rapping position A, the band material 3 is sequentially rapped by the blades 4 of the die drum 5 rotating in synchronism while the band material 3 is being sucked to the outer circumference of the drum 6*a*. Since the die drum 5 is thrust to the drum 6*a* of the conveying drum 6 by compression spring 20, the band material 3 on the drum 6*a* and the blades 4 of the die drum 5 contact each other at the rapping position A, so that rapping may be done with stability.

The band material 3 is divided into work 1 and remainder 2 at the rapping position A, and the work 1 is held by suction to the first intake holes 7, while the remainder 2 is conveyed up to position B while being held by suction to the second intake holes 8. The position B corresponds to the terminal end of the first vacuum groove 33. Thereafter, the work 1 is not sucked by the first intake holes 7, but since the second vacuum groove 35 still continues to operate, the remainder 2 remains fixed to the second intake holes 8.

From position B to position C, only the work 1 is transferred onto a drum 41 having suction means for conveying it to next process. The work 1 terminates its suction due to the first intake holes 7 at position B. The work 1 is not only sucked to the drum 41, but, to transfer it securely, compressed air is sent into the first intake holes 7 through the first intake route 19 from the first feed groove 53 which is in a reverse positive pressure state at position C, so that the work 1 is separated by force from the outer circumference of the drum 6*a*. After position C, until position X, neither positive pressure nor negative pressure is applied to the first intake holes 7.

The remainder 2 is being sent by suction provided by the second intake holes 8 up to position D at the terminal end of the second vacuum groove 35. At position E, the second intake route 34 communicates with the second feed groove 55 in a positive pressure state, and compressed air is reversely blown out from the second intake holes 8. Thus, the remainder 2 is separated from the outer circumference of the drum 6*a* by force. From position D to position E, the separated remainder 2 is sucked and discharged from a discharge duct 21 provided above the conveying drum 6. From position E, until position X, neither positive pressure nor negative pressure is applied to the second intake holes 8.

The first intake route 19 and second intake route 34 return to position X, and the same process is repeated.

Thus far, the portion of one pitch corresponding to the length of the work 1 has been described. On the outer circumference of the drum 6*a,* the first intake hole 7 and second intake hole 8 are provided in every pitch, and by rotation of the conveying drum 6, conveying of band material 3 to the rapping position A, conveying of work 1 to the take-out or removal position C, and conveying of remainder 2 to the discharge position E are performed continuously without interruption.

In this way, the conveying drum 6 comprising the first suction unit S and second suction unit T rotates while suction is applied to the band material 3. Therefore, the band material 3 is conveyed without any particular means such as feed beam 25. Moreover, the conveying drum 6 and the die drum S, having the blades 4, work to rap while rotating securely in synchronism through the gears 16, 17, so that rapping is done while maintaining the dimensional precision in the length-wise direction of the work 1 without using positioning means such as a pilot hole. Accordingly, the conventional feed beam 25 and allowance 26 are not necessary, and the yield of the band material 3 is enhanced.

Furthermore, by forming the first suction unit S, second suction unit T, and the blades 4 on the drum, high speed and continuous rapping is realized, and the productivity is remarkably improved. In addition, since the work 1 and remainder 2 can be sucked separately at the first suction unit S and second suction unit T, removal of the work 1 and discharge of remainder 2 can be done independently, and in particular, conveying of the work 1 to the next process is easy, so that the productivity is further enhanced.

The invention is not limited to the illustrated embodiment alone, but the rapping device may be also composed of conveying means having a suction unit for sucking a band material on a flat belt, a rapping die of the press type similar to that in the prior art, and rapping die driving means for driving the belt of the conveying means intermittently by a step motor or the like and driving the rapping die in synchronism with the conveying speed of the band material on the belt.

The rapping device of the invention can be applied to rapping of not only the band material of kraft paper, but also to band material of resin, or to band material of flexible thin metal plate or the like.

According to the invention, since the conveying means comprises the suction unit, rapping can be done without a feed beam or pilot hole in the band material, and therefore, the width of the works can be equal to the width of the band material, and the yield of the band material may be enhanced remarkably.

Furthermore, by composing the suction unit of the first suction unit and second suction unit, the work can be conveyed to next process independently of the remainder, and the remainder can be conveyed to the take-out position, so that the productivity is further enhanced.

Moreover, because the conveying drum has the suction unit and the die drum has the blades, high speed and continuous rapping is realized, and the productivity is greatly enhanced.

In particular, it is preferred to use the rapping device of the embodiment in forming a separator for battery.

What is claimed is:

1. A rapping method for manufacturing a plurality of works each having a specified shape from a band material comprising the steps of:

(1) providing said band material having a width equal to a width of said works, said width of said band material being in a lateral direction to a direction of travel of said band material, (2) conveying said band material at a conveying speed to a rapping position while applying vacuum suction from a point before said rapping position, said band material being conveyed while in contact with a conveying drum which applies said vacuum suction, (3) rotating a rapping means, said rapping means separate from said conveying drum, for rapping and forming said works in the specified shape and a remainder from said band material on said conveying drum, while said works and said remainder are being held using suction at said rapping position, and (4) conveying i) said works to a first take-out position and ii) said remainder to a second position, while said works and remainder are held to said conveying drum which applies said vacuum suction.

2. A rapping method of claim 1, further comprising the step of:

(5) rotating said rapping means in synchronization with said conveying speed of said band material, wherein said rapping means is a die drum, said die drum comprises plural blades having i) a forming position for rapping and forming said works, and ii) a cutting position for cutting between adjacent works, on a surface of said die drum, and said blades rap and form said band material into said works and said remainder.

3. A rapping method of claim 1, further comprising the steps of:

(5) supplying a first negative air pressure to a first hole in a conveying drum to couple said work to said conveying drum by said first negative pressure at said rapping position, (6) supplying a second negative air pressure to a second hole in said conveying drum to couple said remainder to said conveying drum by said second negative pressure at said rapping position, (7) supplying a first positive air pressure to said first hole to separate said work from said conveying drum at a work take-out position, and (8) supplying a second positive air pressure to said second hole to separate said remainder from said conveying drum at a remainder take-out position, wherein said first hole and said second hole are formed on a surface of said conveying drum.

4. A rapping method of claim 1, wherein said works are separators for a battery.

5. A rapping method of claim 1, wherein said band material includes at least one material selected from the group consisting of paper, kraft paper, resin and metal.

6. A rapping method of claim 1, wherein said vacuum suction is applied by a conveying means, said conveying means is a conveying drum having suction means on a surface of said conveying drum, and said works are rapped by a die drum.

7. A rapping method of claim 1, further comprising the steps of:

(3) conveying said rapped and formed works to a first take-out position while applying suction by a conveying means, and (4) conveying said remainder to a second take-out position while applying suction by said conveying means.

8. A rapping method of claim 1, further comprising the step of:

(3) controlling a position of a vacuum groove formed on a slip disk, said slip disk coupled to a conveying means and sliding along a first surface of said conveying means to an intake hole formed on a second surface of said conveying means.

9. A rapping method of claim 1, further comprising the step of:

(5) conveying said rapped and formed works to a first take-out position while applying suction.

10. A rapping method of claim 9, further comprising the step of:

(6) holding said band material against said surface of said conveying drum at an intake hole in said surface of said conveying drum.

11. A rapping method of claim 1, further comprising the step of:

(5) separating said works from said band material by applying a positive air pressure to said works at said first take-out position.

12. A rapping method of claim 11, further comprising the step of:

(6) blowing air against said remainder at said second take-out position.

13. A rapping method of claim 1, further comprising the steps of:

(5) applying a first suction to a middle portion of said band material, (6) applying a second suction to a side portion of said band material, wherein said first suction and said second suction are provided at intervals based on a length of each work, and a first suction unit and a second suction unit both couple said band material up to said rapping position after rapping, (7) conveying said rapped and formed work to a first take-out position using said first suction, and (8) conveying a remainder of said band material to a second take-out position using said second suction.

14. A rapping method of claim 13, wherein said rapping position, said first take-out position, and said second take-out position are different positions in a rotating direction on an outer circumference of a conveying drum.

* * * * *